United States Patent [19]

Nihira

[11] Patent Number: 4,817,522

[45] Date of Patent: Apr. 4, 1989

[54] PRINTER DEVICE

[75] Inventor: Shohachi Nihira, Tokyo, Japan

[73] Assignee: Citizen Watch Co., Ltd., Tokyo, Japan

[21] Appl. No.: 127,576

[22] Filed: Dec. 2, 1987

Related U.S. Application Data

[63] Continuation of Ser. No. 880,656, Jun. 30, 1986, abandoned, which is a continuation of Ser. No. 614,462, May 25, 1984, abandoned.

[30] Foreign Application Priority Data

May 25, 1983 [JP] Japan ..... 58-91676

[51] Int. Cl.[4] ..... B41J 9/18; B41J 9/38

[52] U.S. Cl. ..... 101/93.34; 101/93.48

[58] Field of Search ..... 101/93.03, 93.21, 93.28, 101/93.29, 93.34, 93.35, 93.48

[56] References Cited

U.S. PATENT DOCUMENTS 3,902,419 9/1975 Pflugbeil et al. ..... 101/93.34 X

FOREIGN PATENT DOCUMENTS 25978 2/1982 Japan ..... 101/93.48
126683 8/1982 Japan ..... 101/93.03
128575 8/1982 Japan .
1436901 5/1976 United Kingdom ..... 101/93.18
1436902 5/1976 United Kingdom ..... 101/93.18

*Primary Examiner*—Charles Pearson
*Attorney, Agent, or Firm*—Koda and Androlia

[57] ABSTRACT

A printer device having a hammer mechanism for printingly impacting a type drum by means of hammer springs. Hammers are rotatably controlled to retracted positions where the hammers are not brought into contact with a reset cam in each printing cycle, so that unnecessary contact between the hammers and the reset cam can be eliminated, frictional loss and noise can be reduced. The hammers are temporarily reset to first retracted positions upon completion of printing, and thereafter, turned to the aforesaid second retracted positions.

The release of locking of the hammers is effected by feeding a printing command to electromagnetic means, whereby an armature of the electromagnetic means moves hammer holding members to thereby release locking of the hammers.

A predetermined pre-stroke is secured between the hammer holding members and the armature at the time of non-excitation of the electromagnetic means, whereby kinetic energy is accumulated while the armature moves within the aforesaid pre-stroke due to the excitation of the electromagnetic means, so that the hammer holding members can be reliably transferred.

5 Claims, 3 Drawing Sheets

PRINTER DEVICE

This is a continuation of application Ser. No. 880,656, filed June 30, 1986, now abondanded, which is a continuation of application Ser. No. 614,462, filed May 25, 1984, now abondanded.

BACKGROUND OF THE INVENTION

1. Field of the Invention

This invention relates to printer devices, and more particularly to an improved printer device of a type, in which a hammer mechanism for printingly impacting a type drum by means of hammer springs is provided and hammers are held in retracted states for respective types by means of a reset cam against the resiliency of the hammer springs.

2. Description of the Prior Art

There have heretofore been well known printers of various types as output devices for data processing units or electronic calculators. As a compact printer, a flying printer is preferable in which hammers are printingly driven onto a type drum provided on the outer periphery thereof with a plurality of types at desirable printing timings. The flying printer can carry out a clear printing operation by the use of an ink ribbon or an ink roll. Normally, the printing onto the type drum is performed through the resiliency of the hammer springs, and a reset cam is used for separating the hammer from the type drum after the printing and resetting the hammers in a retracting state against the resiliency of the hammer springs. It has been known that the reset cam is rotated in synchronism with the type drum or in accordance with a desired printing cycle, whereby the reset cam repeats mechanical contact with the hammers during printing operation of the printer.

In the conventional printers, the aforesaid contacts between the reset cam and the hammers should necessarily be repeated in the respective reset portions, and hence, there have been presented such various disadvantages that the wear due to sliding contact between the reset portion and the hammers and the power consumption caused by the contacting resistance are increased and noise is caused by the impingements and contact between the reset cam and the hammers. Particularly, in compact printers, there have been presented various disadvantages of decreased durability of the printer and of necessity of the provision of a noise cover.

As the improved conventional printer device, there has been proposed a device disclosed in Japanese Patent Laid-Open (Kokai) No. 128575/82, according to which, a retracting cam is provided which turns the hammer to a retracted position out of contact with the reset cam in each printing cycle and, in a hammer holding member, a second holding portion for holding the hammer in the retracted position is provided in addition to a first holding portion for holding the hammer at the retracted state.

In consequence, in the conventional printer device of the type described, the hammer, which has been temporarily turned to the retracted position, is not brought into contact with the reset arm before being used for the succeeding printing action, so that there have been achieved remarkable improvements in reducing the torque loss, noises and so forth.

However, in this device, there has been presented such a disadvantage that, in order to hold the hammer at least at two holding positions including the first retracted position and the second retracted position, a long moving stroke is required of the hammer holding member. Normally, the hammer holding member is of such an arrangement that an armature to be attracted by an electromagnetic solenoid is used, the hammer is held at either one of positions by the armature in non-excited conditions, and an excitation signal or printing signal is fed to the electromagnetic solenoid at a desirable timing to attract the armature instantaneously, whereby the resultant unlatching operation drives the hammers. In consequence, there have been presented such drawbacks that the long moving stroke required of the armature weakens the attracting force of the solenoid, particularly an initial attracting force, whereby a high excitation current is required for compensating for the weakened attracting force and, the electromagnetic means need to be large-sized.

SUMMARY OF THE INVENTION

The present invention has been developed to obviate the above-described disadvantages of the prior art and has as its object the provision of a printer device in which the number of contacts between the reset cam and the hammers is reduced, the durability of the device is improved, noise is lowered and the electromagnetic means can be rendered compact in size in spite of the achievement of the above-described advantages.

To the above end, the printer device of the present invention includes a type drum provided on the outer periphery thereof with a plurality of types; a plurality of hammers provided in the axial direction of the type drum in opposed relations to the types of the type drum; hammer springs for biasing the hammers in the direction of flying to the types, respectively; a reset cam for moving the plurality of hammers to retracted positions against biasing forces of the hammer springs; hammer holding members for being engageable with the hammers, respectively, and holding the hammers at the first retracted positions and second retracted position; and electromagnetic means, each one of which is provided for a number n of the hammer holding members (n is an integer of 2 or more), for selectively releasing the hammers; and the electromagnetic means has a pre-stroke gap of a predetermined value between the hammer holding members and itself at the time of non-excitation and includes an armature for driving the hammer holding members by kinetic energy obtained from a pre-stroke motion of the electromagnetic means within the pre-stroke gap due to the excitation of the electromagnetic means.

DESCRIPTION OF THE PREFERRED EMBODIMENT

Description will hereunder be given of the preferred embodiment of the present invention with reference to the drawings.

Figure 1:
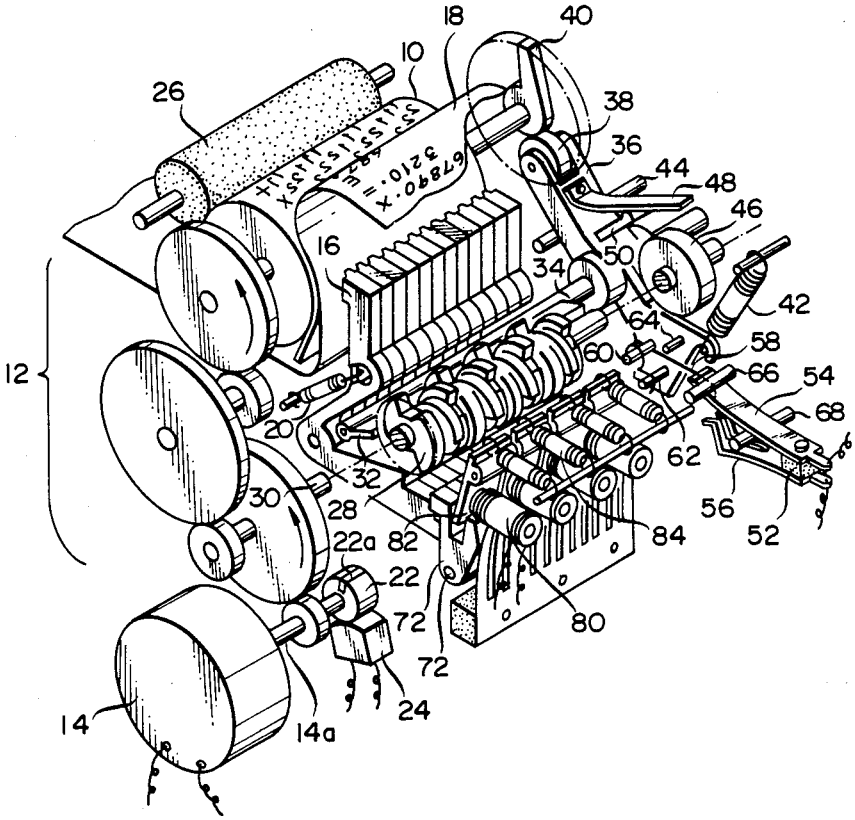
FIG. 1 is a perspective view of the essential portions showing a preferable embodiment of the printer device, to which is applied the reset mechanism according to the present invention.
Figure 2:
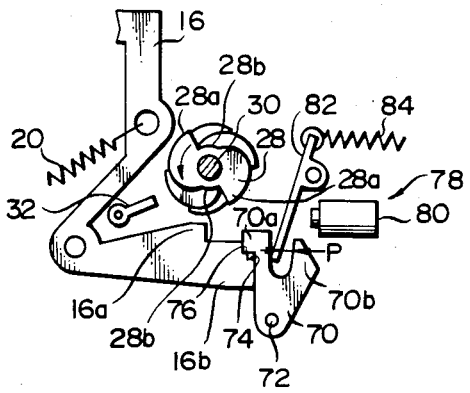
FIG. 2 is an explanatory view of the essential portions showing the second retracted position in FIG. 1.

FIGS. 1 and 2 show the preferred embodiment of the printer device according to the present invention. In the drawings, there is used a three place one electromagnetic means type printer in which one electromagnetic means for releasing hammers from the retracted state in response to a printing command is provided for every three places Furthermore, according to this embodiment, an interruptingly starting type printer is provided in which the printing operation is interrupted upon completion of one printing cycle or completion of one line printing cycle, during which an auxiliary operation such as paper feed is carried out, and subsequently, a start is effected again to perform the succeeding cycle. A type drum 10 is continuously rotated during printing operation by a driving motor 14 through a speed reducing wheel train 12, and a plurality of types provided on the outer periphery of the type drum 10 pass through printing positions in a predetermined order. The hammers for a plurality of places are arranged in opposed relations to the printing positions of the types 10, and a recording paper 18 is inserted between the type drum 10 and the hammers 16. The respective hammers 16 are constantly biased toward the type drum 10 by the hammer springs 20, and, when desirably selected hammers 16 are printed onto the type drum 10 by the biasing force of the hammer springs 20, types being present at the printing positions then are printed onto the recording paper 18.

To detect the respective type positions on the type drum 10, a character pulse generating roller 22 is affixed onto a main shaft 14*a* of the driving motor 14, and character pulses electromagnetically showing the type positions are detected from a magnet portion 22*a* formed on the roller 22 and a reading head 24 disposed adjacent the magnet portion 22*a*.

Additionally, the embodiment indicates an ink roller type printer, in which ink is adheringly fed to the respective types from an ink roller 26 rotating in contact with the type drum 10 to be transferred onto the recording paper 18.

To separate the hammers 16 from the type drum 10 against the biasing force of the hammer springs 20 and transfer the hammers 16 to the first retracted positions, there is provided a reset cam 28. In the embodiment, to rotate the reset cam 28 in synchronism with the type drum 10, a reset cam shaft 30 forms a part of the speed reducing wheel train 12.

In the embodiment, the arrangement of types on the type drum 10 is such that the hammers 16 for three places are controlled by one electromagnetic means, and the respective types in each type set including three places are shifted by $\frac{1}{3}$ line pitch in the direction of line. The reset cam 28 is formed by sets each including three places, and shifted by $\frac{1}{3}$ pitch as apparent from FIG. 2. Additionally, the reset cam 28 shown in the embodiment has a cam contour having the circumference being divided into two, whereby one half turn of the reset cam shaft 30 corresponds to one pitch of type of the type drum 10.

The reset cam 28 is provided on the outer periphery thereof with a reset portion or portions. The reset portion comes into contact with the hammer 16, whereby the hammer 16 is transferred to the first retracted position spaced apart from the type drum 10 against the resiliency of the hammer spring 20. In the embodiment, the reset cam 28 is provided on the circumference thereof with two reset portions. During printing, a reset shoulder 16*a* of the hammer 16, which has fallen into a fall-in portion 28*b* of the reset cam 28, is pushed up by either one of reset portions 28*a* to the first retracted position so as to be reset.

According to the present invention, the hammer 16 can take another retracted position in addition to the aforesaid first retracted position, and, in this second position, the hammer 16 is turned to a position where it does not come into contact with the reset cam 28 against the biasing force of the hammer spring 20, so that such a printer is obtainable in which impingements and contact between the hammer 16 and the reset cam 28, which have heretofore been unavoidable, are completely removed, wear and noise is reduced and the power consumption can be decreased. In this embodiment, the retracting operation of the hammer 16 is carried out in each printing cycle.

According to the present invention, to carry out the aforesaid retracting operation, a retracting cam 32 is provided in the vicinity of the hammers 16. In the embodiment, the hammers 16 for all of the places are simultaneously turned to the second positions by the retracting cam 32. A clear lever 36 is affixed onto a retracting cam shaft 34 of the retracting cam 32, and a roller 38 pivotally supported on one end of the clear lever 36 is urged against and biased to a clear cam 40 concentrically affixed onto the type drum 10 through the resiliency of a spring 42.

In consequence, the clear cam 40 turns the retracting cam 32 through the roller 38 and the clear lever 36 per turn of the type drum 10, i.e. printing cycle, and the retracting operation in each printing cycle as aforesaid is carried out upon completion of the printing. Until the retracting operation is carried out, the clear lever 36 is held at a position where it is in contact with a stopper 44 through the resiliency of the spring 42.

In the case of the interruptingly starting type printer as shown in this embodiment, it is desired to abruptly stop the type drum 10 upon completion of one printing cycle, and hence, in this embodiment there is adopted a brake mechanism using the swinging of the aforesaid clear lever 36. More specifically, a brake drum 46 is affixed onto the reset cam shaft 30 forming the drive wheel train of the type drum 10, while, a brake shoe 48 is affixed to the clear lever 36, whereby the friction therebetween applies an abrupt braking force to the reset cam shaft 30, so that the type drum 10 can be abruptly stopped. Additionally, to make the braking force by the brake shoe 48 satisfactorily large, the brake shoe 48 is assembled into the clear lever 36 in a manner to be previously given an initial torque, and, at the time of non-braking, the brake shoe 48 is brought into contact with a stop bar 50 to thereby prevent the brake shoe from contacting the brake drum 46.

What is a further characteristic in this embodiment is that a printing reference signal can be taken out through the utilization of the swinging action of the clear lever 36 described above. Normally, as a printing reference signal, a reset signal upon completion of one printing cycle is used, and, in response to this reset signal, paper feed and other auxiliary operations are controlled and the printer gets ready for the succeeding line printing.

In the embodiment, a printing reference signal generator is formed of a reset pulse switch including two contact pieces 54 and 56, which interpose an electrically insulated baseplate 52 and are affixed to each other at one side, and the both contact pieces 54 and 56 have the biasing forces in the direction of approaching and contacting each other. One 54 of the contact pieces is engaged with a switch operating element 58 comprising a wire spring held by the aforesaid clear lever 36, whereby the contacted conditions between both contact pieces 54 and 56 are controlled in accordance with the swinging position of the clear lever 36.

Figure 3:
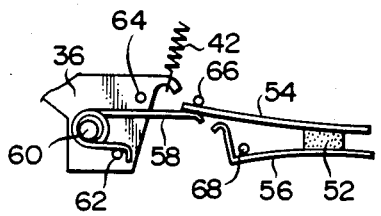
FIG. 3 is an explanatory view of the essential portions showing the reset pulse switch in FIG. 1.

As apparent from FIG. 3, the switch operating element 58 is held by the clear lever 36 through a support pin 60 and regulated in its position by stopper pins 62 and 64. Both the contact pieces 54 and 56 are also regulated in their positions by stopper pins 66 and 68, respectively.

FIG. 3 shows the normal conditions where the clear lever 36 is turned in the counterclockwise direction to a position where it abuts against a stopper (Refer to FIG. 1) through the resiliency of the spring 42, with the result that the switch operating element 58 pushes up the contact piece 54 to a position where it abuts against the stopper pin 66. At this time, the other contact piece 56 of the contact pieces is regulated by the stopper pin 68, whereby the both contact pieces 54 and 56 are in released states.

Figure 4:
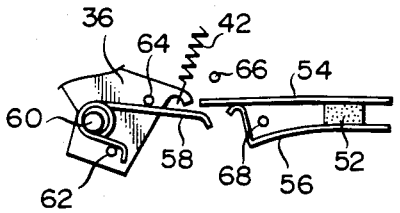
FIG. 4 is a view in explanation of the action of FIG. 3 showing the time of reset pulse output.

On the other hand, upon completion of one printing cycle, the clear lever 36 is turned in clockwise direction by the clear cam 40 as aforesaid In consequence, as shown in FIG. 4, the switch operating element 58 is separated from the contact piece 54 and can output reset pulses due to the contact between the both contact pieces 54 and 56.

As has been described hereinabove, according to this embodiment, the printing reference signal can be taken out through the utilization of the mechanical swinging motion essential to the clear lever.

Now, according to the present invention, it is necessary to hold the hammers 16 at the first and second retracted positions, therefore, in the present invention, the above-described both positions are held by hammer holding members, for example hammer lock levers, with no necessity of directly engaging the armature of the electromagnetic means.

The hammer lock levers 70 for holding the hammers 16 to retracted positions in this embodiment are provided for the respective places in association with the respective hammers 16 and arranged and pivotally supported by a shaft 72.

Then, the hammer lock lever 70 includes therein a lock arm **70*a* engageable with or disengageable from a lock end 16*b* of the hammer 16 and a release arm 70*b* extending towards a lock arm 70*a* in a bifurcated manner and engageable with an armature of electromagnetic means to be described hereunder. The respective hammer lock levers 70 are provided in association with the hammers 16, respectively, and can hold or release the hammers 16 separately of other places. According to the present invention, the number n (n is an integer of 2 or more) of hammer lock levers 70 are formed into one group. In the embodiment, three hammer lock levers 70 are commonly controlled by one electromagnetic means. However, after the applying of an printing command to a solenoid is released, the hammer lock levers 70 respectively cooperate with the hammers 16** associated therewith, so that the frictional loss and the generation of noises of the printer can be removed for the respective places.

Figure 5:
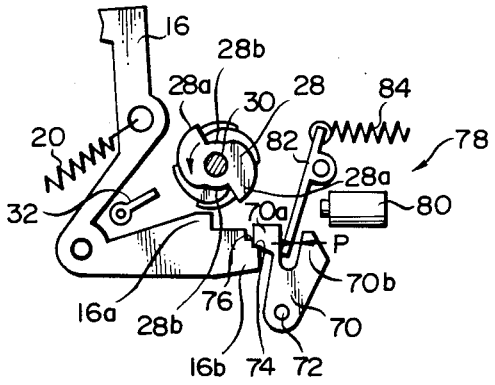
FIG. 5 is a view in explanation of the action of FIG. 2 showing the first retracted position of the hammer.

According to the present invention, to hold both the first retracted position and the second retracted position of the hammer 16, between the hammer 16 and the hammer lock lever 70 there are provided a first engaging portion for holding the hammer 16 at the first retracted position and a second engaging portion for holding the hammer 16 at the second retracted position. In the illustrated embodiment, the first engaging portion is formed by a first engaging groove 74 provided on the holding arm **16*b* of the hammer 16, and similarly, the second engaging portion is formed by a second engaging groove 76 provided on the holding arm 16*b* of the holding arm 16*b*. The first engaging groove 74 shallowly holds the hammer 16 at the first retracted position (Refer to FIG. 5), while, the second engaging groove 76 deeply holds the hammer 16 at the second retracted position (Refer to FIG. 2), so that, according to the present invention, the deep holding at the second retracted position makes it possible to completely eliminate the contact of the hammers 16 with the reset cam 28 as shown in FIG. 2**.

To release the holding or locking of the hammers 16 by the hammer lock levers 70 in response to the applying of an printing command, the electromagnetic means 78 are provided, and each electromagnetic means 78 is associated with the hammer lock levers 70 for three places, thus contributing to rendering the printer device compact in size. The electromagnetic means 78 includes a solenoid 80 excitable in response to an printing command, an armature 82 attractable by the solenoid 80 and an armature spring 84 for separating the armature 82 from the solenoid 80.

In consequence, when a printing command is applied in the hammer lock conditions as shown in FIG. 2, the armature 82 is attracted by the solenoid 80 to turn in the counterclockwise direction, whereby the armature 82 engages the release arm **70*b* to thereby rotate the hammer lock lever 70 in the clockwise direction. As the result, the lock arm 70*a* is disengaged from the lock end 16*b* of the hammer 16**, so that a desired printing operation can be achieved.

The present invention features that, at the time of non-excitation of the electromagnetic means 78 shown in FIG. 2, a play gap of a predetermined value formed between the armature 82 and the release arm **70*b* of the hammer lock lever 70, whereby, during a pre-stroke of the armature 82, which moves within the aforesaid play gap at the time of excitation of the electromagnetic means 78, the armature 82 is given an initial speed sufficient for pulling out the hammer lock lever 70. In consequence, in spite of that the stroke of the armature 82 is lengthened in order to position the hammer 16 at both the first retracted position and the second retracted position, the armature 82 is given a high initial speed by the free flying of the armature 82** during the pre-stroke at an initial stage of the attraction, so that the hammer lock can be reliably released.

The embodiment of the present invention is of such an arrangement as described above, and the printing action and the hammer reset action thereby will be hereunder be described.

The printing action itself in this embodiment is similar to the conventional one, in which the hammer 16 selected by the reset cam 28 and the electromagnetic means 78 is printingly driven onto the type drum 10, whereby a desirably selected type is printed The hammers 16 are reset at the first retracted positions for the respective types by the rotation of the reset cam 28. However, in general, in the printer of the type described, in order to secure the engagement between the hammer 16 and the holding means, i.e. the armature 82, such an arrangement is adopted that the reset cam 28 resets the hammer 16 in a manner to push up the hammer 16 beyond a value required for holding and engaging the hammer 16. Because of this, each time the reset cam 28 engages the hammer 16, impingements and contact occur therebetween, whereby wear and noise is generated to a notable extent. However, according to the present invention, the hammer 16 is retracted from the reset cam 28 in one printing cycle by the retracting cam 32, so that the aforesaid contacts can be completely eliminated.

Figure 6:
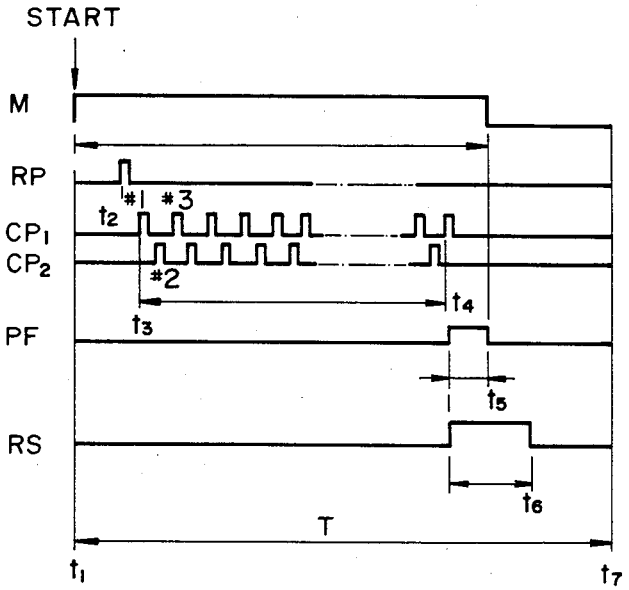
FIG. 6 is a timing chart of the embodiment.

FIG. 6 shows the timing chart of the embodiment, according to which a desirable one line printing and paper feed are carried out in one printing cycle T ranging from a time $t_1$ to a time $t_7$. More specifically, electric current is passed to a motor 14 (M) at the time $t_1$, and thereafter, the type selection and the printing action are carried out by reset pulses RP obtained from the reset pulse switch and character pulses $CP_1$–$CP_2$ obtained from the reading head 24. In consequence, until a printing section $t_3$–$t_4$ is reached, the hammer 16 is held at the first retracted position since the time immediately after the printing. Hence, in this section, the hammer 16 and the reset cam 28 repeat the contact therebetween in the same manner as before. However, according to the present invention, simultaneously with the paper feed PF upon the completion of the printing, the aforesaid retracting action RS by the retracting cam 32 is carried out from the time $t_4$ to the time $t_6$, due to this retracting action the hammer 16 is retracted to the position where it does not contact the reset cam 28 as shown in FIG. 2, and thereafter, this non-contact conditions are continuously maintained until the hammer 16 is used for the printing. As has been well known, there are cases where the places in the upper side out of all the places in the printer are hardly used for the printing actions. In such cases as described above, according to the present invention, the places, for which wasteful contacts have heretofore been repeated, can be completely held in non-contact conditions.

As has been described hereinabove, the present invention can offer such advantages that the hammer is turned to the retracted position in each printing cycle, useless contacts, which would otherwise have been seen between the hammers and the reset cam, can be eliminated, the generation of frictional loss and noises can be reduced to a considerable extent, and particularly, the present invention is suitably applicable to a compact printer driven by a battery.

According to the present invention, the armature is given an initial speed at the time of hammer lock release, so that the exciting force of the solenoid can be effectively used to reliably release the hammer locking.

What is claimed is:

1. A printer device comprising:

a type drum provided on an outer periphery thereof with a plurality of types;

a plurality of hammers provided in the axial direction of said type drum and having one end in opposed relations to the types of said type drum and an other end provided with at least two engaging notches of a depth which are different from each other;

hammer springs for biasing said hammers in directions of flying to said types, respectively;

a reset cam for moving said plurality of hammers to a first retracted position against biasing forces of hammer springs;

hammer holding members for being engageable with said engaging notches of said hammers, respectively, and for holding each of said hammers at the first retracted position when engaging with one engaging notch and at a second retracted position when engaging with the other engaging notch, each of said hammer holding members being formed in a bifurcated shape including two arms, and an outer side of one arm of which is engageable with and disengagable from said two engaging notches of said hammer to alternately hold said hammer at the retracted position and to release said hammer; and a plurality of electromagnetic means, each one of which is provided for at least two of said hammer holding members for selectively actuating said hammer holding members and selectively releasing said hammers, said electromagnetic means including an armature disposed to be movable between said two arms of said hammer holding member, said armature being movable between a first position engaging an inner side of said one arm when the electromagnetic means is not excited, and a second position engaging the other of said two arms when said electromagnetic means is excited for selectively releasing said hammers, wherein, in said first position, the inner side of said one arm acts as a stopper for said armature so ad to define a pre-stroke gap between said armature and said hammer holding members;

wherein said pre-stroke gap is a predetermined value between the other of said two arms of said hammer holding members and said armature at the time of non-excitation and said armature moves within the pre-stroke gap during excitation of said electromagnetic means such that said armature is given sufficient speed to strongly push the other arm by inertial force thereof, and disengage said one arm from said one of said two engaging notches;

whereby said hammer holding members can be readily disengaged from the one of said two engaging notches of the hammer.

2. A printer device as set forth in claim 1, wherein one electromagnetic means is provided for three hammer holding members, respectively.

3. A printer device as set forth in claim 1, wherein a retracting cam for turning each of said hammers to the second retracted position is provided.

4. A printer device as set forth in claim 3, further comprising a reset shoulder provided on said hammer for engagement with said reset cam for turning each of said hammers to said first retracted position.

5. A printer device as set forth in claim 4, further comprising a pulse generating roller coupled to said type drum to rotate together therewith, a magnetic portion provided in said pulse generating roller and a magnetic reading head provided adjacent said pulse generating roller to detect respective type positions on said type drum.

* * * * *